United States Patent [19]

Eguchi

[11] Patent Number: 4,781,478

[45] Date of Patent: Nov. 1, 1988

[54] TECHNIQUE FOR AUTOMATIC CENTERING OF CARRIAGE IN A PRINTING APPARATUS TO ASSIST WITH INSERTION OF PAPER

[75] Inventor: Toru Eguchi, Shizuoka, Japan

[73] Assignee: Tokyo Electric Co., Ltd., Tokyo, Japan

[21] Appl. No.: 904,686

[22] Filed: Sep. 5, 1986

[30] Foreign Application Priority Data

Sep. 17, 1985 [JP] Japan ..... 60-204824

[51] Int. Cl.[4] ..... B41J 19/30

[52] U.S. Cl. ..... 400/279; 400/322; 400/708

[58] Field of Search ..... 400/708, 708.1, 2, 625–629, 400/322, 279

[56] References Cited

U.S. PATENT DOCUMENTS

| | | | |
|---|---|---|---|
| 1,988,189 | 11/1935 | Dobson | 197/138 |
| 2,366,206 | 1/1945 | Metzner | 197/130 |
| 3,968,868 | 7/1976 | Greek | 400/2 X |
| 4,189,135 | 2/1980 | Gosta | 400/625 X |
| 4,279,523 | 7/1981 | Ringle | 400/322 X |
| 4,326,815 | 4/1982 | Kapp | 400/625 |
| 4,469,460 | 9/1984 | Hughes | 400/322 |
| 4,489,931 | 12/1984 | Costa | 400/625 X |

*Primary Examiner*—Paul T. Sewell

*Attorney, Agent, or Firm*—Frishauf, Holtz, Goodman & Woodward

[57] ABSTRACT

A printing apparatus includes a platen, a carriage, a guide member, and a carriage drive. A printing head is mounted on the carriage. The carriage can move in the axial direction of the platen, so that the printing head can print data on a sheet of paper set on the platen. The guide member guides the sheet of paper inserted in the gap between the platen and the guide member, into the gap between the platen and the printing head. The carriage driver moves the carriage to a predetermined position within a region opposing the central portion of the platen when no sheet of paper is detected to be set on the platen.

14 Claims, 7 Drawing Sheets

TECHNIQUE FOR AUTOMATIC CENTERING OF CARRIAGE IN A PRINTING APPARATUS TO ASSIST WITH INSERTION OF PAPER

BACKGROUND OF THE INVENTION

The present invention relates to a printing apparatus having a carriage provided with a paper guide for guiding a sheet of paper into the gap between a platen and a printing head.

Printing apparatuses are known which each comprise a cylindrical platen for holding and feeding a sheet of paper, a carriage which can move in the axial direction of the platen, and a printing head mounted on the carriage and having a plurality of dot-printing elements for printing characters on the sheet of paper supported on the platen. To set a sheet of paper around the platen of a printing apparatus of this type, the sheet is inserted into a slit formed between the upper plate of the housing of the apparatus and the platen, and extending parallel to the platen. When the platen is rotated either manually or by an electric motor, with the front edge of the sheet inserted in the slit, the sheet is guided toward the front of the apparatus along the circumference of the platen by the paper guide provided below the platen.

The front edge of the paper guide is located below the platen. Were it to protrude into the path of the carriage positioned in front of the platen, it would prevent the carriage from moving. Since the front edge of the paper guide is located below the platen, the front edge of the sheet might not pass through the gap between the platen and the printing head mounted on the carriage. To avoid this possibility, most printing apparatuses of this type have another smaller paper guide attached to the carriage, to guide the front edge of the sheet into the gap between the platen and the printing head.

The printing apparatus with two such paper guides has the following problem:

The paper guide attached to the carriage cannot be long, extending along the platen. The longer this guide, the shorter the distance the carriage can move. Inevitably, then, the guide attached to the carriage must be short. Hence, when a narrow sheet of paper is guided by the paper guide provided below the platen while the carriage is held at the leftmost or rightmost position, the front edge of the sheet may not abut on the guide attached to the carriage and, therefore, might not pass through the gap between the platen and printing head.

If this happens, the operator of the apparatus needs to rotate the platen in the reverse direction until the front edge of the sheet returns to the front edge of the paper guide located below the platen. Then, the operator manually moves the carriage to or close to the center position. Thereafter, the operator rotates the platen in the forward direction, whereby the front edge of the sheet can be guided through the gap between the platen and the printing head. However, when the carriage is manually and/or forcibly moved, its position is altered from that stored in a memory provided within the printing apparatus. In this case, the operator must firstly turn off the power supply switch and then turn it on again, in order to write the actual position of the carriage in the memory.

SUMMARY OF THE INVENTION

The object of the present invention is to provide a printing apparatus wherein the carriage is automatically positioned to oppose the center portion of the platen when no sheet of paper is supported on the platen.

To achieve this object, a printing apparatus according to the invention comprises: a platen; a carriage supporting a printing head for printing data on a sheet of paper wrapped around the platen, and being movable in the axial direction of the platen; a guide member attached to the carriage and opposing the platen, for guiding a sheet of paper which is inserted in the gap between the platen and the guide member, into the gap between the platen and the printing head; and a carriage driver for moving the carriage to a predetermined position within a region opposing the center portion of the platen when no sheet of paper is detected to be supported on the platen.

In this invention, the carriage is automatically moved to the position where it opposes the center portion of the platen, when it is detected that no sheet of paper is supported on the platen. Therefore, when a sheet of paper is set around the platen, the guide member can reliably guide the sheet into the gap between the platen and the printing head.

DETAILED DESCRIPTION OF THE PREFERRED EMBODIMENT

Figure 1:
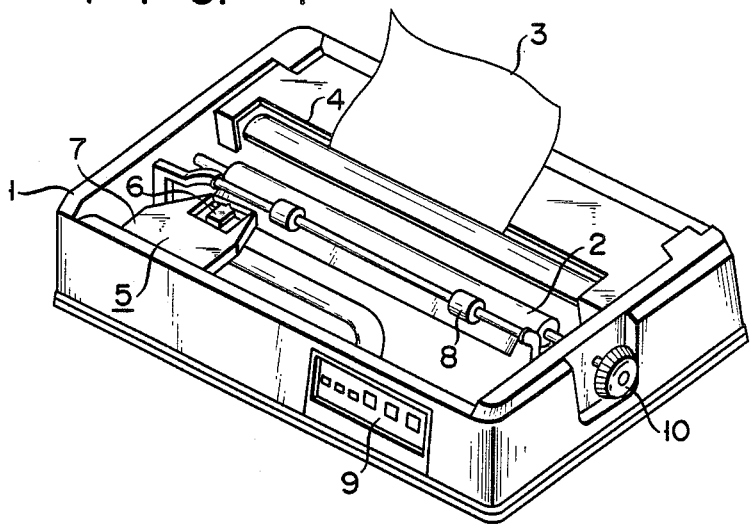
FIG. 1 is a perspective view of a printing apparatus according to one embodiment of the present invention, with its top cover removed.

FIG. 1 is a perspective view of a printing apparatus of this invention, with its top cover removed. The apparatus has housing 1 and cylindrical platen 2 provided within this housing. Paper insertion gap 4 is provided between platen 2 and the edge of the top plate of housing 1, which is located behind platen 2. Gap 4 extends parallel to platen 2. Sheet of paper 3 can be inserted into paper insertion gap 4. Carriage 5, which can be moved along platen 2 by an electric motor (not shown in FIG. 1), is provided within housing 1. Printing head 6 having dot-printing elements for printing characters, is mounted on carriage 5. Further, ribbon cassette 7 and guide plate 13 (shown in FIG. 2) for guiding sheet 3 into the gap between platen 2 and printing head 6, are also mounted on carriage 5. Paper-holding rolls 8 are used to press the sheet of paper against the platen after it has passed between the platen and printing head. Switch panel 9 with a power supply switch, paper feed switch and other switches arranged on it, is attached to the front of housing 1. Platen 2 can be rotated when platen knob 10 coupled thereto is manually turned.

Figure 2:
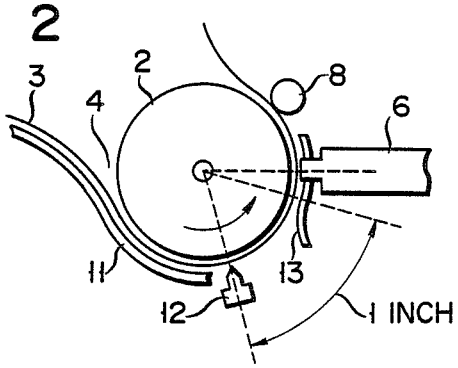
FIG. 2 is a cross-sectional view showing the platen, printing head, and some other components of the printing apparatus shown in FIG. 1.

FIG. 2 is a cross-sectional view of the printing section of the apparatus, including platen 2 and printing head 6. As is shown in this figure, paper guide 11 for guiding a sheet of paper fed through 3 paper insertion gap 4, is provided within housing 1. The front edge portion of paper guide 11 is located below platen 2 and is curved along the circumference thereof. Paper detector 12 comprising a light-emitting diode and a phototransistor, is provided near the front edge of paper guide 11 and is used to detect the presence or absence of sheet 3 at the front edge of paper guide 11. Guide plate 13 is attached to carriage 5, and guides sheet 3 from paper guide 11 into the gap between platen 2 and printing head 6. It extends along platen 2 for a distance substantially equal to the width of ribbon cassette 7.

When the operator turns platen knob 10, thereby rotating platen 2 in the direction of the arrow (FIG. 2), with the front edge portion of sheet 3 inserted in paper insertion gap 4, the sheet is guided by paper guide 11, it abuts on guide plate 13, is further guided by plate 13 into the gap between platen 2 and printing head 6, and passes through this gap. When platen knob 10 is further turned, thus rotating platen 2 in the same direction, sheet 3 passes between platen 2 and paperholding rolls 8, and is finally discharged from the top of housing 1.

Figure 3:
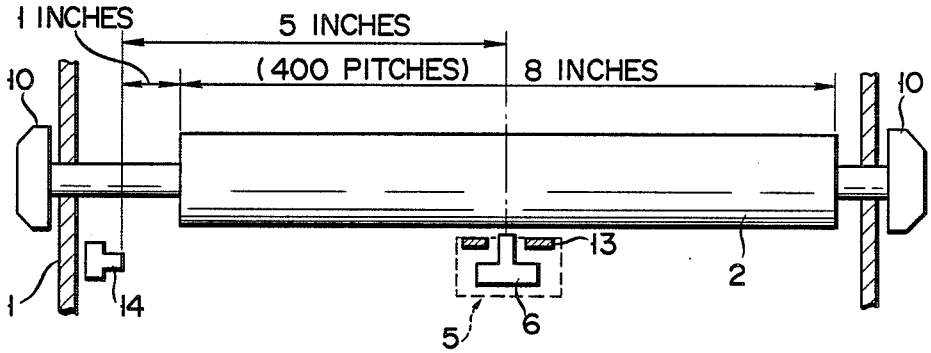
FIG. 3 shows the positional relationship between the platen and carriage of the printing apparatus.

FIG. 3 shows the distance over which carriage 5 can move in the axial direction of platen 2. Platen 2 is eight inches long. Home position detecting sensor 14 is located at distance of five inches from the center of platen 2. Sensor 14 is designed to detect when carriage 5 is at its home position.

Figure 4:
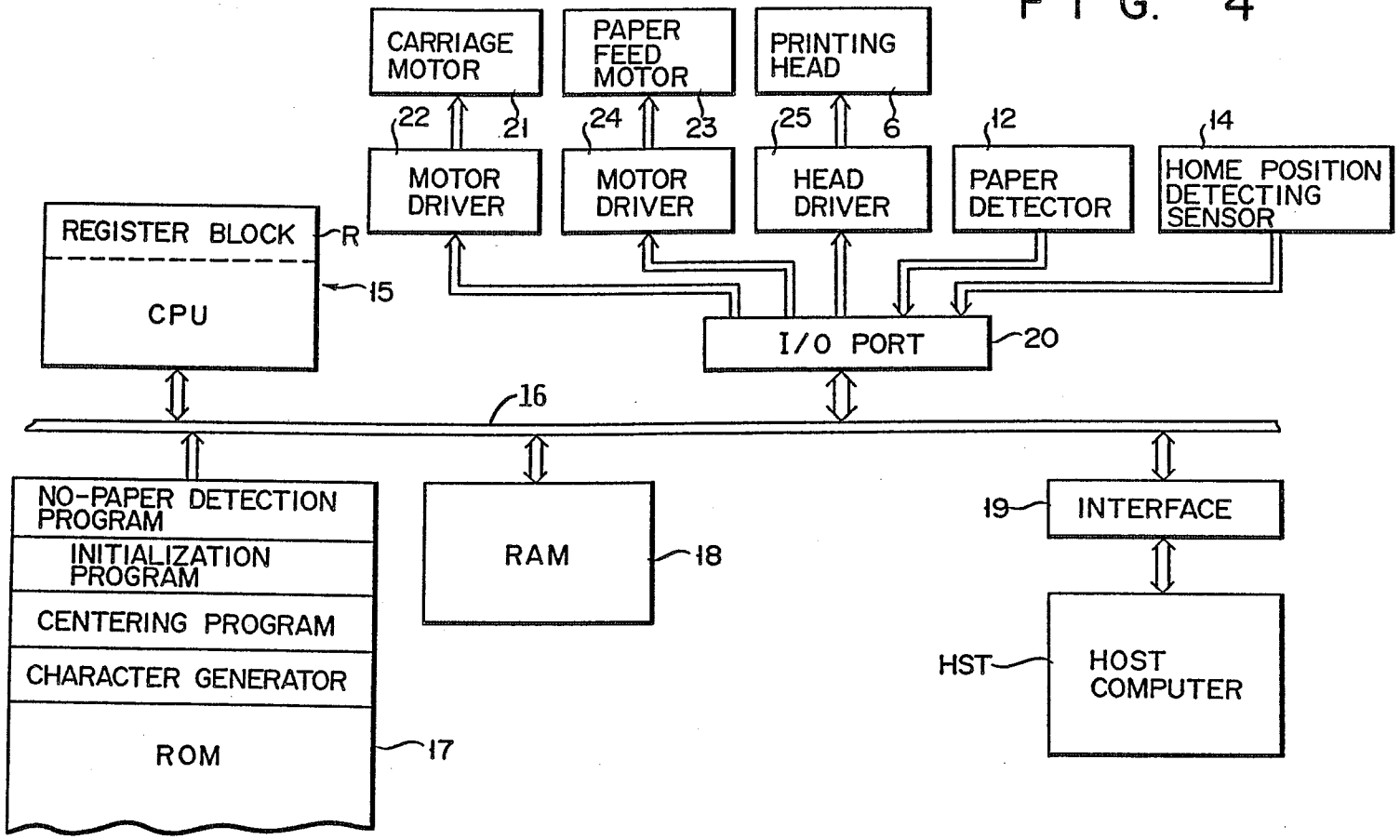
FIG. 4 is a block diagram showing the electric circuit of the printing apparatus shown in FIG. 1.

FIG. 4 is a block diagram showing the electric circuit of the printing apparatus. The electric circuit has CPU 15 containing register block R and adapted to perform various arithmetic operations. CPU 15 is connected by bus line 16, which comprises address buses and data buses, to ROM 17, RAM 18, interface circuit 19, and input/output port 20. ROM 17 stores fixed data such as a no-paper detection program, an initialization program, a centering program, and a character generator for generating dot character patterns. RAM 18 is used to store pieces of variable data. Interface circuit 19 can receive the data to be printed, from host computer HST provided outside the printing apparatus. Input/output port 20 is provided to give drive instructions to the drive means of the printing apparatus and to receive various detection signals from paper detector 12, home position detecting sensor 14, and the like.

Paper detector 12, home position detecting sensor 14, motor drives 22 and 24, and head drive 25 are connected to input/output port 20. Carriage motor 21 for moving carriage 5 is connected to motor drive 22. Paper feed motor 23 for feeding sheet of paper 3 is electrically coupled to motor drive 24. Printing head 6 is connected to head drive 25.

Figure 5:
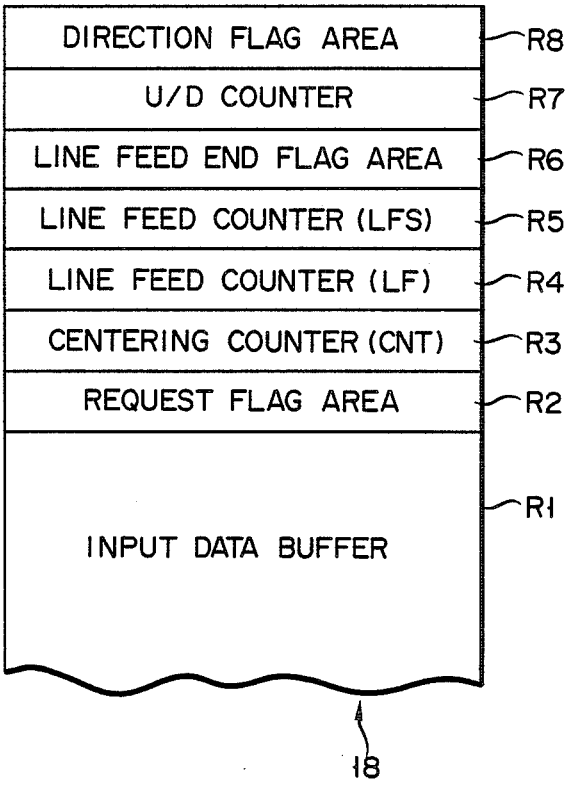
FIG. 5 illustrates the memory map of the RAM used in the apparatus of FIG. 1.

As is illustrated in FIG. 5, RAM 18 comprises input data buffer R1, request flag area R2, centering counter R3, line feed counter R4, another line feed counter R5, line feed end flag area R6, up-down counter R7, and direction flag area R8. Input data buffer R1 is provided to temporarily store the data supplied from interface circuit 19, such as character codes and carriage-return data. Request flag area R2 can store a flag requesting that carriage 5 be moved to the center of platen 2. Centering counter R3 is designed to count pitches or units of distance over which the carriage moves from its home position during the centering process. Line feed counter R4 can count the pitches or units of distance over which sheet 3 is fed forward during the line feed operation. Line feed counter R5 is designed to count the pitches or units of distance over which sheet 3 can be further fed forward after its rear edge has passed paper detector 12. Line feed end flag area R6 stores the flag indicating that sheet 3 can be fed no further forward. Up-down counter R7 counts the units of distance between carriage 5 and sensor 14. Direction flag area R8 stores the flag representing the direction in which carriage 5 is moving during the centering process.

Figure 6:
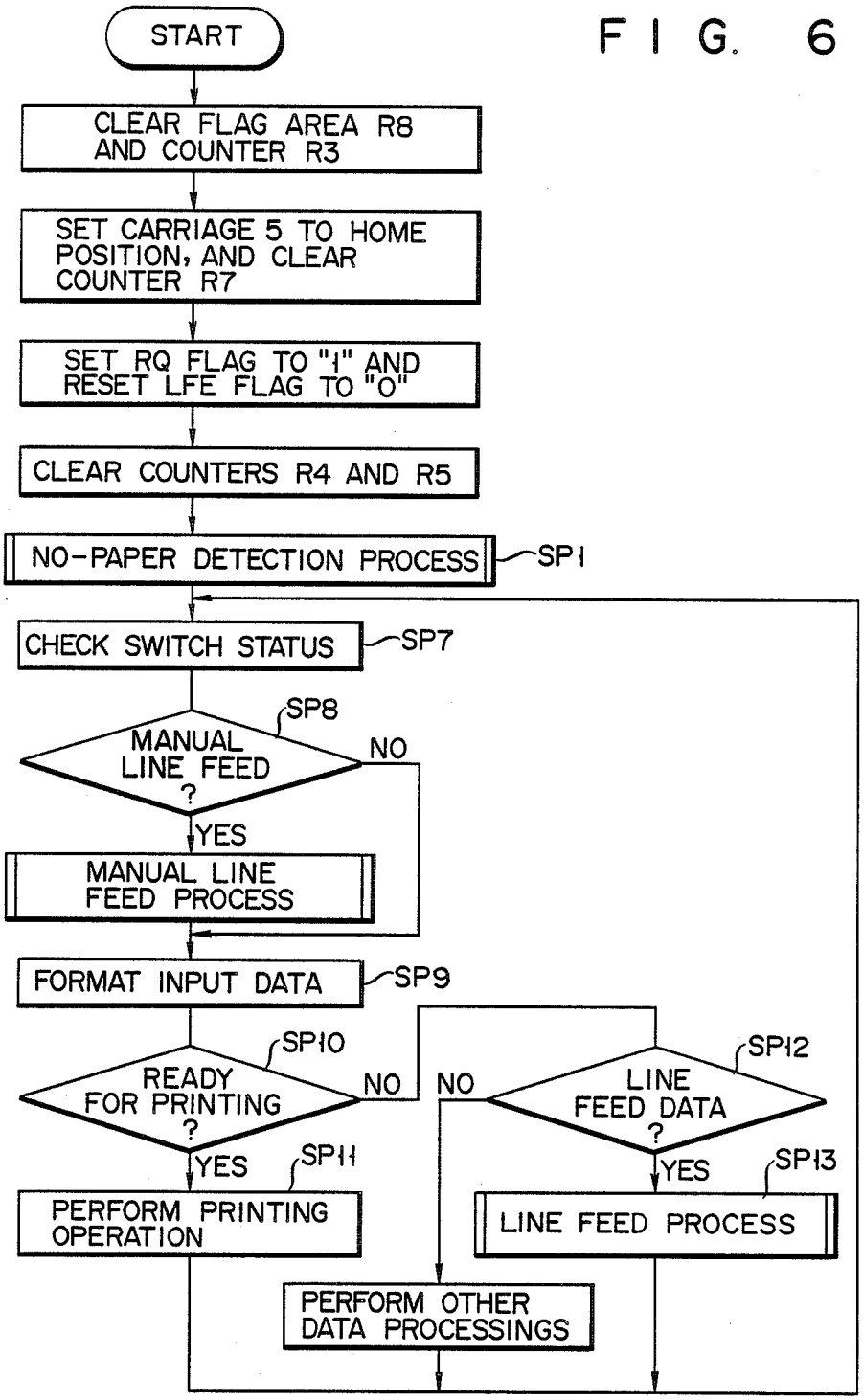
FIG. 6 is a flow chart explaining the operation of the electric circuit shown in FIG. 1.

Once the power supply switch of the printing apparatus is turned on, CPU 15 starts executing the main routine shown in FIG. 6. More specifically, when the power supply switch is turned on, CPU 15 initializes centering counter R3 and direction flag area R8 of RAM 18, in accordance with the initialization program stored in ROM 17. CPU 15 drives carriage motor 21, thereby moving carriage 5 to the left until home position detecting sensor 14 detects carriage 5 and generates a detection signal, whereupon carriage 5 is stopped at its home position. Simultaneously, CPU 15 initializes up-down counter R7. Then, CPU 15 sets the request (RQ) flag stored in flag area R2 to "1," and resets the line feed end (LFE) flag stored in flag area R6 to "0." Further, CPU 15 resets the counts LF and LFS of line feed counters R4 and R5 to "0." Thereafter, in step SP1, CPU 15 executes the no-paper detection program read out from ROM 17, which is detailed in FIG. 7.

Figure 7:
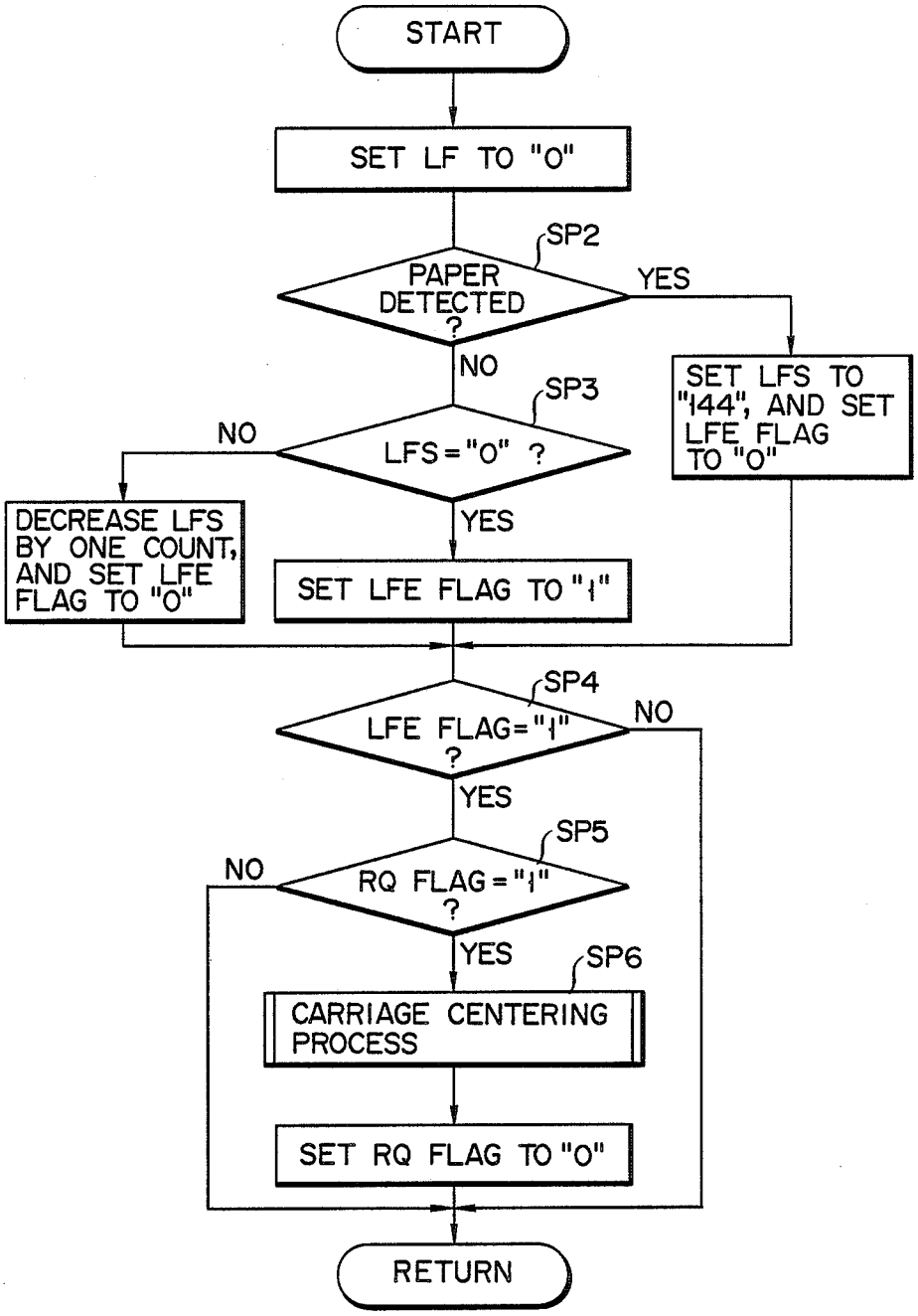
FIG. 7 is a flow chart showing the no-paper detection process included in the operation illustrated in FIG. 6.

As is shown in FIG. 7, CPU 15 sets count LF of counter R4 (i.e., the number of pitches or units of line feed distance) to "0." In step SP2, it is determined whether or not paper detector 12 has detected a sheet of paper. No sheets are usually set around platen 2 immediately after the power supply switch has been turned on. If NO in step SP2, CPU 15 carries out step SP3. In step SP3, it is determined whether or not count LFS of line feed counter R5 is "0." If YES, the LFE flag stored in line feed end flag area R6 is set to "1." Then, in step SP4, it is determined whether or not the LFE flag has been set to "1." If YES in step SP4, CPU 15 determines, in step SP5, whether or not the RQ flag stored in request flag area R2 has been set to "1." If YES in step SP5, CPU 15 executes the centering program read out from ROM 17, in step SP6. As this program is executed, as illustrated in FIG. 8, carriage 5 is automatically moved to the center of platen 2.

Figure 8:
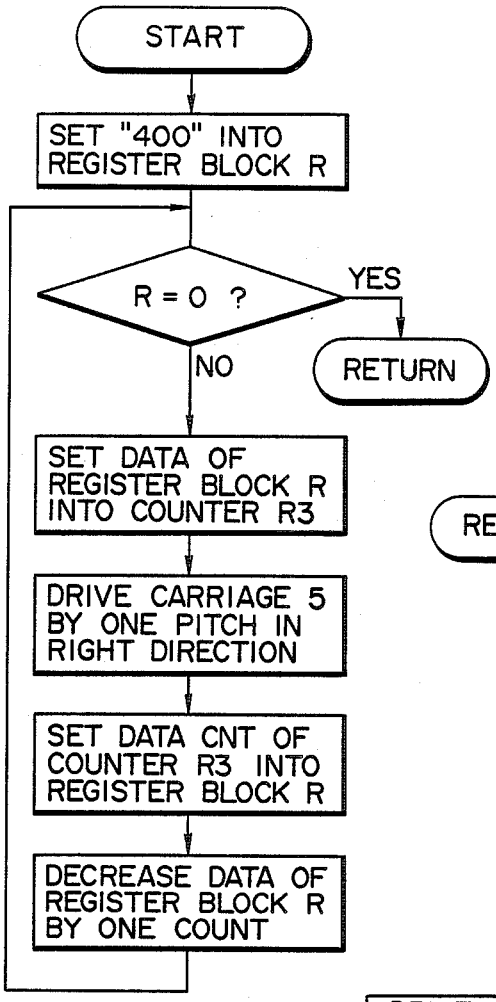
FIG. 8 is a flow chart showing the carriage-centering process included in the operation illustrated in FIG. 7.

To be more precise, as is shown in FIG. 8, pitch number data "400" is written in register block R. Data "400" represents five inches, i.e., the distance between the home position of carriage 5 and the center of platen 2. This data also corresponds to 400 pulses to be supplied to carriage motor 21. Therefore, every time motor 21 receives one pulse, it moves carriage 5 by 1/80 inch, toward the center of platen 2, and, at the same time, the data stored in register block R is reduced by one. So, when the value of the pitch number data in register block R is reduced to "0," CPU 15 determines that carriage 5 has arrived at the center of platen 2. Thus, carriage 5 is automatically moved to the center of platen 2. The operation then returns to the flow of FIG. 7. Since register block R is used when carriage motor 21 is driven, it is necessary to preserve the contents of register block R. For this purpose, the data is transferred from register block R to centering counter R3 of RAM 18 before the carriage-centering process is started. The data is returned from counter R3 to register block R after carriage 5 has been moved to the center of platen 2.

When step SP6 (FIG. 7), i.e., the carriage-centering, is completed, the RQ flag stored in request flag area R2 is reset to "0," whereby the no-paper detection process is finished. The operation then returns to the flow of FIG. 6.

Assume now that sheet of paper 3 is set around platen 2 when the power supply switch is turned on. If this is the case, CPU 15 determines, in step SP2, whether or not paper detector 12 has detected sheet 3. The LFS count of counter R5 is set to "144," and the LFE flag stored in flag area R6 is reset to "0." Hence, NO in step SP4, whereupon the operation returns to the main routine shown in FIG. 6, without performing the carriage-centering process.

When the no-paper detection process (one of the processes of the main routine in FIG. 6) is completed, CPU 15 determines that the printing apparatus has been initialized. In step SP7, the conditions of the switches arranged on switch panel 9 are checked. In step SP8, it is determined whether or not the manual line feed switch has been closed. If NO in step SP8, the input data is read out from input data buffer R1 of RAM 18 and is edited in a proper data format in accordance with the character dot patterns stored in the character generator of ROM 17, thereby forming data representing one line of characters, in step SP9. As soon as any piece of the input data is supplied to interface circuit 19 from host computer HST, it is written in input data buffer R1.

In step SP10, it is determined whether or not oneline data has been prepared and a print instruction has been given. If YES in step SP10, CPU 15 performs the printing operation, in step SP11. More precisely, carriage 5 is moved to the home position, and is then moved to the right at a constant speed. While carriage 5 is being moved to the right, printing head 6 mounted on carriage 5 prints the characters of this line, one after another, on sheet of paper 3. When the one-line printing is finished, the operation returns to step SP7, in which the conditions of the switches of panel 9 are again checked.

If NO in step SP10, that is, if neither one-line data has been prepared nor a print instruction given, then it is determined, in step SP12, whether or not the input data is line feed data. If YES in step SP12, the number of pitches or units of distance over which sheet 3 should be fed is read out of input data buffer R1 of RAM 18 and written in line feed counter R4 of RAM 18. One pitch or one unit of line feed distance is equal to the distance over which sheet 3 is fed every time paper feed motor 23 rotates one step. In this embodiment, one unit of line feed distance is 1/144 inch. Hence, when the one-line feed distance is 1/6 inch, the number of units of line feed distance, i.e., the LF count, is "24." The LF count is determined by the height of the characters and the interval between the lines. In step SP13, the line feed process illustrated in FIG. 9 is performed.

Figure 9:
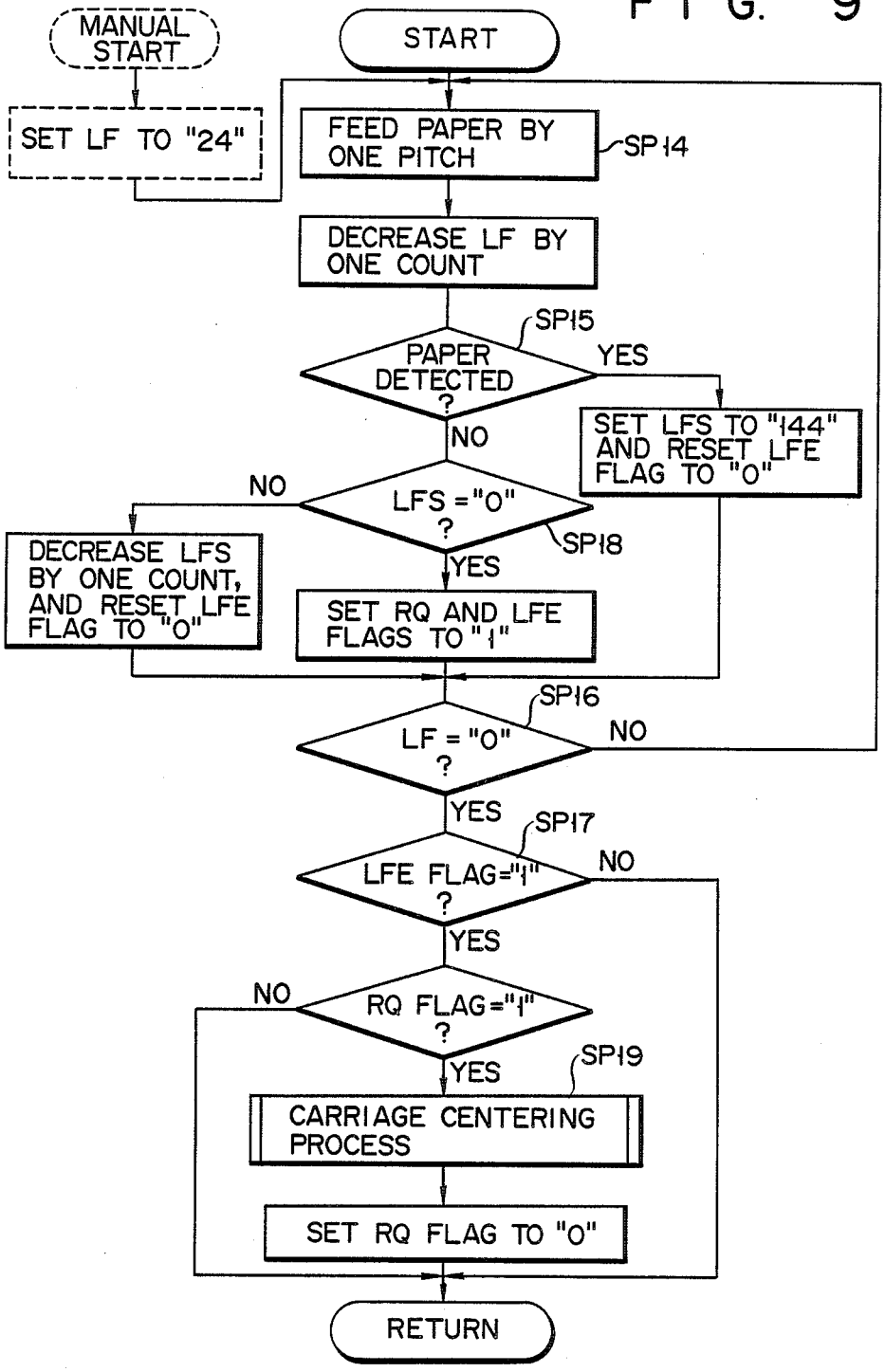
FIG. 9 is a flow chart showing the line feed process performed in the operation illustrated in FIG. 6.

As is shown in FIG. 9, paper feed motor 23 is rotated, one step at a time, thereby feeding sheet 3 one unit of distance at a time. Every time the paper feed motor is rotated one step, the LF count of line feed counter R4 of RAM 18 is reduced by one count. In step SP15, CPU 15 determines whether or not paper detector 12 has detected sheet 3. If YES, CPU 15 sets the LFS count of line feed counter R5 to "144" which corresponds to a line feed distance of one inch. Therefore, as long as paper detector 12 detects sheet 3, the LFS count remains "144", representing one inch. (This means that sheet 3 can be fed for one inch after paper detector 12 has detected the rear edge of sheet 3.) Then, CPU 15 resets the LFE flag to "0." Thereafter, in step SP16, it is determined whether or not the LF count of line feed counter R4 has decreased to "0." If NO in step SP16, the flow returns to step SP14, in which sheet 3 is further fed by one unit of line feed distance, or 1/144 inch.

On the other hand, if YES in step SP16, that is, if the LF count has been reduced to "0," the flow proceeds to step SP17. In step SP17, it is determined whether or not the LFE flag is "1." Since the LFE flag is "0" at this time, the decision is NO, and the operation returns to the main routine shown in FIG. 6.

If NO in step SP15, that is, if paper detector 12 detects no sheet of paper, it is determined that the rear edge of sheet 3 has left paper detector 12, and the LFS count of line feed counter R5 has become less than "144." In step SP18, CPU 15 determines whether or not the LFS count has decreased to "0." If NO, the LFS count of line feed counter R5 is decreased by one, the LFE flag is reset to "0," and the flow goes to step SP16. If NO in step SP16, that is, if the LF count has not been reduced to "0," the flow returns to step SP14, in which sheet 3 is further fed by one unit of line feed distance, or 1/144 inch.

Conversely, if the LF count of line feed counter R4 has decreased to "0" before the LFS count of line feed counter R5 is detected, in step SP18, to have decreased to "0," the operation returns to the main routine of FIG. 6. On the other hand, if the LFS count is detected to have decreased to "0" before the LF count, the LFE flag and RQ flag are set to "1." Thereafter, paper feed motor 23 continues to rotate until the LF count is detected, in step SP16, to have decreased to "0," though the rearmost printable portion of sheet 3 has left printing head 6. Then, it is determined whether or not the RQ flag is "1." If NO, the operation returns to the main routine shown in FIG. 6. In this instance, the RQ flag has been set to "1," and the flow goes to step SP19. In step SP19, the carriage-centering process is performed as illustrated in FIG. 10.

Figure 10:
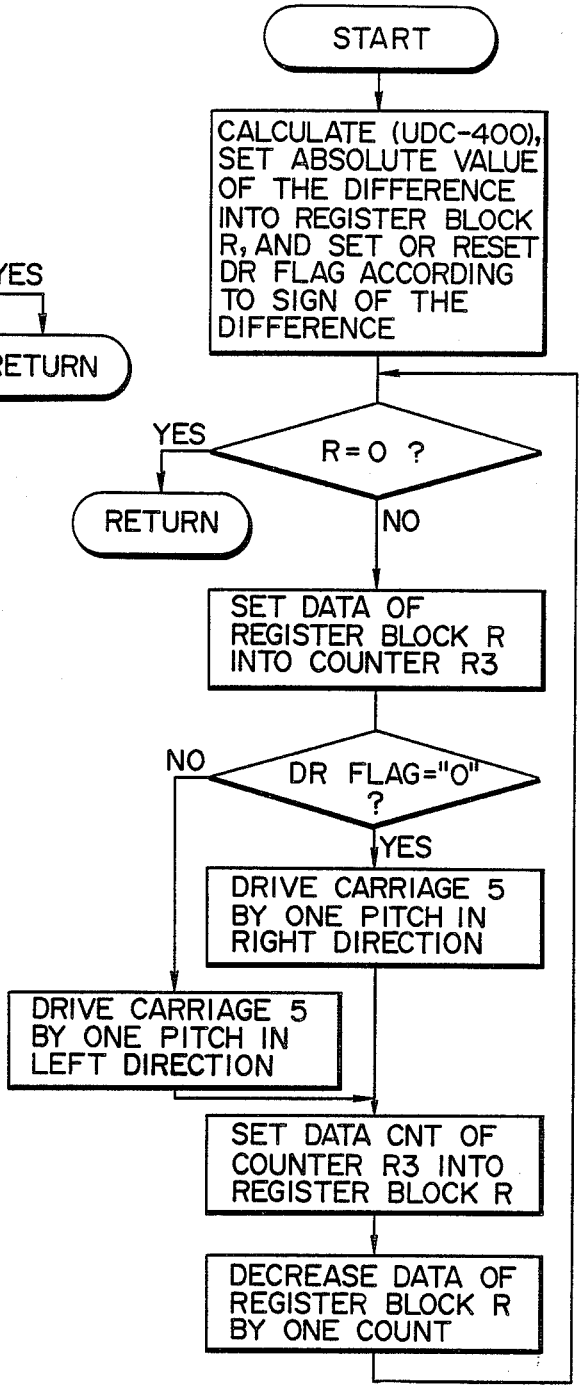
FIG. 10 is a flow chart explaining another line feed process performed in the operation shown in FIG. 6.

In the carriage centering process, of FIG. 10 CPU 15 first subtracts "400" from count UDC of up-down counter R7. The absolute value of the difference obtained is stored in register block R. At the same time, a DR flag of "1," which indicates that carriage 5 should be moved to the left, is set in direction flag area R8 when the difference is positive in value, that is, when carriage 5 is positioned to the right of the center of platen 2 and count UDC is greater than "400." Conversely, a DR flag of "0," which indicates that carriage 5 should be moved to the right, is set in direction flag area R8 when the difference is negative in value, that is, when carriage 5 is located to the left of the center of platen 2, and count UDC is less than "400." Thereafter, steps similar to those shown in FIG. 9 are carried out. To be more specific, CPU 15 supplies one pulse to carriage motor 21, thereby moving carriage 5 by one pitch or one unit of distance, to the left or to the right, in accordance with the value of the DR flag set in direction flag area R8, and reduces count R stored in register block R. Carriage 5 is moved until count R is reduced to "0." When it is detected that count R has become "0," the carriage centering process (FIG. 10) is completed, and the operation returns to the flow shown in FIG. 9. Hence, as shown in FIG. 9, the RQ flag is reset to "0,"

and the operation returns to the main routine illustrated in FIG. 6.

If YES in step SP8 of the main routine, that is, if the manual feed line switch has been turned on, the manual line feed process is performed. More specifically, the LF count of line feed counter R4 of RAM 18 is set to "24" which is equal to a line feed distance of 1/6 inch, as is illustrated by the broken-line box shown in FIG. 9. Thereafter, step SP14 et seq., shown in FIG. 9, are executed.

In the printing apparatus of the structure described above, carriage 5 is automatically moved to the center of platen 2 as soon as the power supply switch is turned on, if sheet of paper 3 is not correctly set around platen 2 when the power supply switch is turned on. When the number of remaining printable lines of sheet 3 decreases to less than a predetermined value, paper detector 12 detects no paper, after which platen 2 is rotated to feed sheet 3 for the distance corresponding to the number of remaining printable lines. When the last line is printed on sheet 3, carriage 5 is automatically moved to the center of platen 2, namely, carriage 5 moves to the center of platen 2 only when a new sheet of paper needs to be set around platen 2.

The front edge of the new sheet inserted through paper insertion gap 4 can therefore abut on guide plate 13 attached to carriage 5, and can readily be guided through the gap between platen 2 and printing head 6, even if it is relatively narrow. Hence, the operator need not bother to check to see whether or not the sheet has been correctly set around platen 2. Nor should the operator have to manually move carriage 5 to the center of platen 2. In short, the operator's burden is lightened, and the efficiency of setting sheets around platen 2 can be raised.

Moreover, since carriage 5 is not moved to the center of platen 2 until the remaining printable lines, (the number of which corresponds to the LFS count of line feed counter R5) are printed, the data can be printed on sheet 3 close to the rear edge thereof, and thus, sheet 3 can be used to the maximum extent. Further, since the LFS count can be set to any desired value, paper detector 12 can therefore be positioned in any desired location along the circumference of platen 2.

As is described above, in the present invention, the carriage is automatically moved to the center of the platen when no sheets of paper are wrapped around the platen. A sheet of paper can be set around the platen both readily and accurately, thus reducing the operator's burden and improving the paper-setting efficiency.

Only one embodiment has been explained. This does not mean that the present invention is limited to this embodiment. For example, the carriage can be automatically moved to a position at a distance of 3.5 to 6.5 inches from paper detector 12, instead of being moved to the center of the platen. Furthermore, when the carriage is located in any position opposing a predetermined central portion of the platen, the moment the paper detector detects no sheets wrapped around the platen, the carriage can be prohibited from moving, and when the carriage is located in any other position not opposing the central portion of the platen, it can be automatically moved to a predetermined position opposing the central portion of the platen. Further, it is possible to set detector 12 close to guide plate 13 so that the carriage can be moved to the predetermined position opposing the central portion of the platen immediately after no sheet of paper is detected on the platen.

What is claimed is:

1. A printing apparatus comprising:

a platen;

a carriage supporting a printing head for printing data on a sheet of paper set on the platen, and being movable in the axial direction of the platen;

a first guide member attached to the carriage and opposing the platen, for guiding a sheet of paper which is inserted in a first gap between the platen and the first guide member into a second gap between the platen and the printing head;

carriage drive means for moving the carriage to a predetermined position within a region opposing the central portion of the platen; and first control means for sensing an occurrence of removal of said sheet of paper from said second gap, and for actuating said carriage drive means upon such an occurrence to move said carriage to the predetermined position.

2. A printing apparatus according to claim 1, further comprising a second guide member for guiding the sheet of paper along the circumference of the platen into the gap between the platen and the first guide member.

3. A printing apparatus according to claim 2, wherein said carriage drive means has detector means for generating an output signal upon detecting that no sheet of paper is set on the platen, and second control means responsive to the output signal from the detector means, for moving the carriage to the predetermined position within the region opposing the central portion of the platen.

4. A printing apparatus according to claim 3, wherein said detector means has a photodetector provided near the front edge of the second guide member, for detecting the sheet of paper being guided by the second guide member.

5. A printing apparatus according to claim 4, wherein said second control means has a memory for storing the data representing the position of the carriage, and a drive control unit responsive to the output signal from the detector means, for moving the carriage over the distance between the predetermined position and the position of the carriage represented by the data stored in the memory.

6. A printing apparatus according to claim 5, further comprising a position detector for detecting the home position of the carriage, wherein said second control means moves the carriage to the home position when a power supply switch is turned on, and then moves the carriage to the predetermined position in response to the output signal from the detector means.

7. A printing apparatus according to claim 1, wherein said carriage drive means has detector means for generating an output signal upon detecting that no sheet of paper is set on the platen, and second control means responsive to the output signal from the detector means, for moving the carriage to the predetermined position within the region opposing the central portion of the platen.

8. A printing apparatus according to claim 7, wherein said second control means has a memory for storing the data representing the position of the carriage, and a drive control unit responsive to the output signal from the detector means, for moving the carriage over the distance between the predetermined position and the position of the carriage represented by the data stored in the memory.

9. A printing apparatus according to claim 8, further comprising a position detector for detecting the home position of the carriage, wherein said second control means moves the carriage to the home position when a power supply switch is turned on, and then moves the carriage to the predetermined position in response to the output signal from the detector means.

10. A printing apparatus according to claim 3, wherein said second control means includes distance measuring means for detecting a distance over which said sheet of paper is fed after the output signal is generated from said detecting means, and a control unit connected to said distance measuring means to move said carriage to the predetermined position when detecting that the distance detected by said distance measuring means has reached a preset value.

11. A printing apparatus according to claim 10, wherein said distance measuring means is counting means whose contents are changed each time said sheet of paper is fed by a preset unit of feed distance.

12. A printing apparatus according to claim 1, wherein said first control means includes detector means for detecting the end of said sheet of paper while the sheet of paper is fed.

13. A printing apparatus according to claim 12, wherein said detector means is located a preset distance ahead of the platen in a paper feeding direction.

14. A printing apparatus according to claim 13, wherein said first control means includes means responsive to the output of said detector means and to the number of lines the sheet of paper is fed in the paper feeding direction to determine said occurrence of removal of the sheet of paper from the second gap.

* * * * *